United States Patent [19]

Padamsee

[11] Patent Number: 4,487,637

[45] Date of Patent: Dec. 11, 1984

[54] PURIFICATION OF NIOBIUM

[75] Inventor: Hasan S. Padamsee, Ithaca, N.Y.

[73] Assignee: Cornell Research Foundation, Inc., Ithaca, N.Y.

[21] Appl. No.: 594,592

[22] Filed: Mar. 29, 1984

Related U.S. Application Data

[63] Continuation-in-part of Ser. No. 542,808, Oct. 14, 1983.

[51] Int. Cl.[3] ..... C21D 1/00

[52] U.S. Cl. ..... 148/6.3; 75/84; 148/133

[58] Field of Search ..... 148/133, 6.3; 75/84

[56] References Cited

PUBLICATIONS

Klatt et al. Z. Fur. Metal, 1978, 67: 568–572.

Shibata et al., *Trans. Japan Institute of Metals*, 1980, 21: 639–644.

Kirchheim et al., *Aeta Metallurgica*, 1977, 27: 869–878.

Kirchheim et al., Scripta Metallurgica, 1977, 11: 651–654.

Peterson et al., *Metallurical Transactions A*, 1981, 12A: 1127–1131.

Yoshinari et al., *J. Less Common Metals*, 1981, 81: 239–248.

*Primary Examiner*—Sam Silverberg

[57] ABSTRACT

This invention relates to a method of purifying niobium containing an impurity having a significant diffusion rate above about 1000° C. which comprises vapor depositing a film of yttrium (Y) upon the surface of the niobium to be purified in a vacuum greater than about $10^{-4}$ torr and at an elevated temperature above about 1000° C. (preferably between about 1200° C. and 1400° C.) for a time sufficient to cause migration of impurities from the niobium and binding of the impurities by the yttrium metal. The process of the invention, in it presently preferred embodiment can be accomplished by bringing the surface of shaped niobium article into close proximity with the yttrium metal under the appropriate process conditions.

6 Claims, 2 Drawing Figures

PURIFICATION OF NIOBIUM

Figure 1:
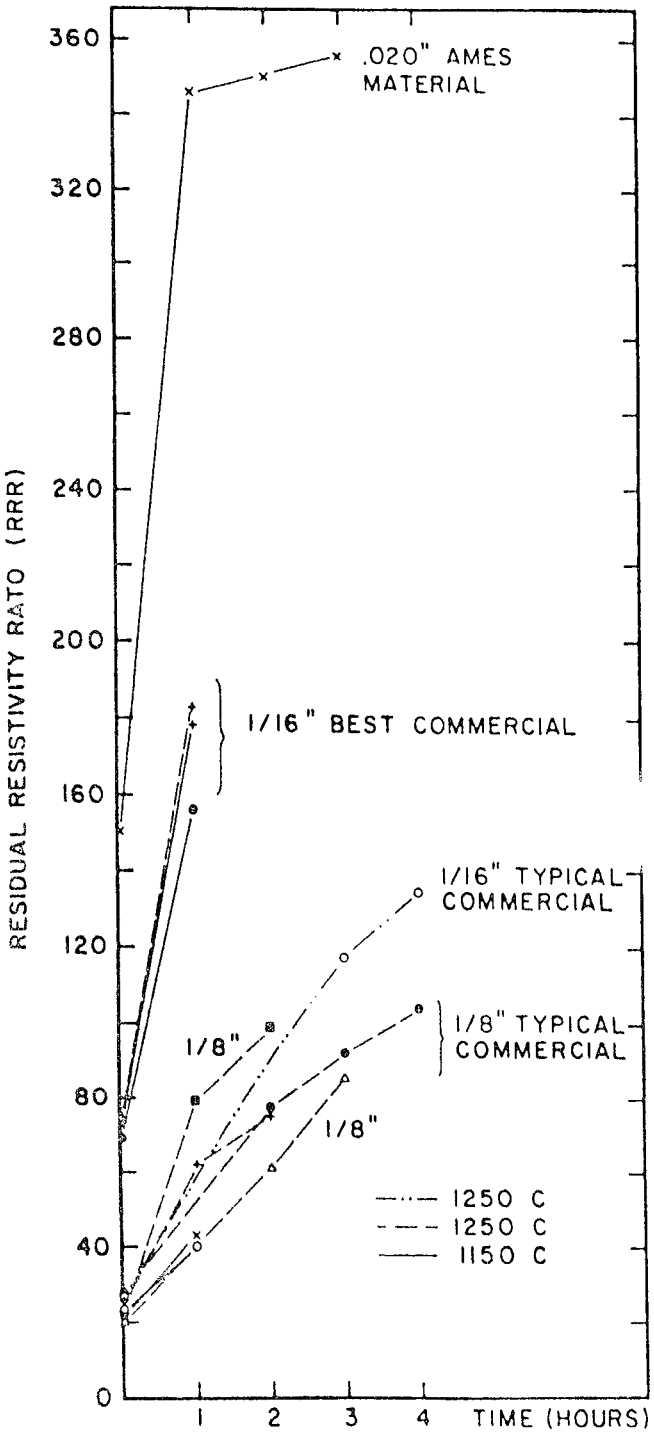

This invention was funded in part under NSF Contract No. PHY80-2220. Therefore, The Federal Government has certain license rights.

CROSS-REFERENCE TO RELATED APPLICATION

This application is a continuation-in-part of application Ser. No. 542,808 filed Oct. 14, 1983.

BACKGROUND OF THE INVENTION

Niobium (Nb), melting temperature 2450° C., (also called Columbium) is a difficulty purified metal.

Pure metal applications of niobium are based on its properties of high corrosion resistance, high electrical conductivity, good ductility and its superconductivity below 9.2K.

There has been significant and growing utilization of rf superconductivity for nuclear physics accelerators and high energy accelerators. It is anticipated that the $e^+e^-$ storage rings LEP, TRISTAN, and PETRA will install large sections of niobium superconducting accelerating cavities, Tigner, 1983, *IEEE TRANS., NS*-30, 3309. Improvements in currently achievable performance levels (which are far below theoretical expectations) will lead to significant enhancements of these planned applications as well as to new applications. Currenty one of the dominant limitation mechanisms is "quenching" of the superconductivity near isolated regions of high losses—referred to as defects. Improved understanding of this phenomena shows that it can be considerably ameliorated by improving the thermal conductivity of the Niobium between 4.2 and 9.2K; Padamsee, 1983, *IEEE Trans., Mag*-19, 1322.

The thermal conductivity of Nb at these temperatures is strongly dependent on the purity of the metal. Dissolved gas impurities such as O, C, N and H go in between atomic sites (interstitially) and degrade the conductivity substantially. It is common to find 10–150 ppm (by weight) of interstitial impurities in commercially available pure Nb metal. In particular, since Nb has a very high affinity for O, this impurity is usually found at the highest levels. Other commonly found impurities such as Ta and W replace the regular atomic sites (substitutionally). In general substitutional impurities are far less harmful than interstitial impurities.

The electrical resistance of Nb at low temperature (e.g. 4.2K) in the normal state is also very sensitive to the total interstitial impurity content. This property correlates so well with impurity content that it is usually used as a measure of the total impurity content. The ratio of the electrical resistance of Nb at room temperature to the electrical resistance in the normal state at 4.2K is defined as the Residual Resistivity Ratio (RRR). Table 1 lists the RRR value for 1 weight ppm of the most commonly found imputities, Schulze, *J. Metals*, May 1981, p 33. Commercially pure Nb has typical RRR values between 20 and 40, corresponding to overall interstitial content of between 100 and 200ppm.

TABLE 1

The Effect of Impurities on the RRR of Niobium

| Element | RRR for 1 wt ppm |
|---|---|
| O | 5000 |
| N | 3900 |
| C | 4100 |

TABLE 1-continued

The Effect of Impurities on the RRR of Niobium

| Element | RRR for 1 wt ppm |
|---|---|
| H | 1550 |
| Ta | 550,000 |

From the theoretical calculation of Kadanoff and Martin, 1961, *Phys. Rev.*, 124:670, which gives the ratio of thermal conductivity of the superconducting state to the normal state and from the Wiedemann Franz Law which connects normal state thermal conductivity with electrical conductivity, one can derive the rule:

$$RRR \approx 400\ K_s(4.2K)$$

where $K_s$ is thermal conductivity of Niobium in the superconducting state at 4.2K measured in watts/cm-K. Commercially pure Nb has $K_s$(4.2K) values between 0.05 and 0.1 watts/cm-K.

Reducing the interstitial impurity content has a profound effect on the thermal conductivity of Nb. To remove the dominant impurity, O, it is necessary to heat Nb at temperatures above 1900° C. in a vacuum furnace of pressure lower than $10^{-8}$ torr, Fromm et al, 1969, *Vacuum*, 19:191. The pressure must be at these excellent levels in the hot zones. Unfortunately this is often found not to be the case for high temperature ultra high vacuum (UHV) furnaces of the type at High Energy Physics Laboratory, Stanford University, Stanford, California (HEPL), Brookhaven National Laboratory, Upton, N.Y. (BNL) or Kernforschungszentrum, Karlsruhe, West Germany (KFK). These furnaces are usually found to increase the O content. In other furnaces, e.g. at Max Planck Institute, Stuttgart, West Germany (MPI) where more efficient pumping arrangements exist, the ultra high vacuum, high temperature treatment to remove oxygen usually takes a long time (e.g. several hours for 3 mm Nb), because purification rates are controlled by evaporation rate of the oxides of Nb from the surface, and these are very slow: Schulze, Supra. Removal of carbon (decarburization) is accomplished by heating Nb between 1650° and 1800° C. in an oxygen atmosphere of $10^{-6}$ torr Fromm et al, Supra. This process usually increases the O content, so it becomes necessary to further apply difficult O removal methods described above. Removal of N takes place under conditions similar to O removal but more slowly: Cost et al, 1963, *Acta Metallurgica*, 11:231. Fortunately there is usually less N contamination in commercial Nb than O or C. Removal of H is the easiest. Heat treatment above 800° C. in a moderately good vacuum ($P < 10^{-5}$ torr) is effective in reducing H to below the 1 wt ppm level.

Solid state de-oxygenation is a process whereby a metal, which has a higher affinity to oxygen is brought into contact with the metal to be purified, and acts as a sink for interstitial diffusion of oxygen. Kirchheim et al, *Acta Metallurgica*, 1979, 27:869–878 and *Scripta Metallurgica*, 1977 11:651–654. The technique has been applied largely to vanadium using titanium and zirconium as sinks, Peterson et al, *Metallurgical Transactions A*, 1981, 12*A*:1127–1131: Yoshinari et al, *J. Less Common Metals*, 1981, 81:239–248, and to a lesser extent to niobium using zirconium as a sink, Shihata et al, *Trans. Japan Institute of Metals*, 1980, 21:639–644. The following reference appears material or related to the present invention:

Klatt et al *Z. Fur. Metal,* 1978, 67: 568–572, which describes the protection of niobium with a coating of titanium as a getter, in conjunction with molybdenum and silicon barriers.

DESCRIPTION OF THE INVENTION

This invention relates to a method of purifying niobium containing an impurity having a significant diffusion rate above about 1000° C. which comprises vapor depositing a film of yttrium (Y) upon the surface of the solid niobium to be purified in a vacuum greater than about $10^{-4}$ torr and at an elevated temperature above about 1000° C. (preferably between about 1200° C. and 1400° C.) for a time sufficient to cause migration of impurities from the niobium and binding of the impurities by the yttrium. The process of the invention, in its presently preferred embodiment can be accomplished by bringing the surface of shaped niobium article into close proximity with the yttrium under the appropriate process conditions.

The use of yttrium offers substantial improvements over that of other metals such as titanium or zirconium. The vapor pressure of yttrium is almost 10 times higher than that of titanium and almost a million times higher than that of zirconium at temperatures between 1200° and 1400° C. Thus a thicker coating of yttrium can be obtained in the same time. Both zirconium and titanium have substantial solid solubility in niobium whereas yttrium has very little (less than 0.05%), reducing the possibility of contamination of niobium, F.A. Shunk, *Constitution of Binary Alloys,* Second Supplement, McGraw-Hill. Thus yttrium allows shorter purification times or lower purification temperatures or greater material thickness.

The process of this invention includes additional technical advantages. A relatively low purification temperature as compared to prior processes, involving UHV outgassing allowing complicated structures to be treated with less risk of deformation; and, less stringent vacuum requirements allowing the use of diffusion pumped furnaces rather than ultra high vacuum technologies. Both deposition and purification are accomplished in one furnace run.

In the process of the invention the niobium to be purified, usually in the form of a shaped article, for example a sheet, tube or wire, is placed in close proximity to yttrium metal which has a higher affinity for the impurity sought to be removed than does niobium and which, at the purification temperature and pressure employed, is capable of vapor depositing a film of yttrium upon the surface of the niobium. Under the purification conditions, apparently, the vapor deposited film of yttrium reacts with the impurities (e.g. O) available at the niobium surface, strongly binding the impurity and rendering the niobium surface poorer in the impurity with respect to the interior of the niobium. A concentration gradient is thus established from the bulk to the surface. Driven by the gradient, the impurity migrates from the interior toward the surface where it is continuously absorbed by the yttrium metal. Continued vapor deposition of yttrium metal presents fresh yttrium metal as the already deposited layer is consumed by binding impurity.

For example, when a sheet, tube or wire of niobium is loosely wrapped in a foil of yttrium and the combination is heated above about 1000° C. in a vacuum of better than about $10^{-4}$ torr, the vapor pressure of yttrium is sufficiently high ($10^{-7}$ torr and increasing with temperature) so that a thin film of yttrium is deposited on the niobium surface. Above 1000° C., the diffusion rate of oxygen in niobium ($5\times10^{-7}$ $cm^2$/sec and increasing with temperature) is sufficiently high that the purification is accomplished in some hours; Powers et al, 1957, *J. Applied Phys.,* 30:520.

It is noted that during the process of the invention, the impurities from the furnace vacuum are also intercepted by the yttrium metal layer and prevented from entering the niobium and increasing the contamination. Without the yttrium metal layer the high affinity of niobium for oxygen normally would lead to additional contamination at temperatures above 1000° C. and pressures less than about $10^{-4}$ torr.

The process of the invention which particularly adapted to remove oxygen impurity also removes nitrogen, although in smaller amounts. Since the diffusion rate of nitrogen in niobium is 60 times less than oxygen ($9\times10^{-9}$ $cm^2$/sec) less nitrogen is removed per unit time.

Vapor phase metal deposition techniques are known in the art and the deposition of the yttrium metal film can be conducted by such methods. However, the presently preferred process as described herein comprises purifying niobium in the form of a shaped article about which a shaped article of yttrium metal is placed in close proximity (i.e. touching or within a distance sufficient to allow vapor deposition of yttrium metal on the niobium under the conditions employed). Preferably the purifier metal shaped article does not touch the niobium or touches only at a number of points sufficient to support the yttrium metal shaped article about the niobium article.

The pressure employed in the process of the invention is a reduced pressure of less than $10^{-4}$ torr which, in combination with the particular purifier metal, temperature, and time, causes yttrium metal to deposit upon the niobium and causes migration of oxygen from the niobium to the yttrium metal.

The temperature employed in the process of the invention is a temperature above 1000° C. which, in combination with the pressure, causes yttrium metal to deposit upon the niobium and causes migration of oxygen from the niobium to the yttrium metal. Optimum temperature and time also depends on the thickness of the niobium being purified, its starting oxygen content and the final oxygen content desired (or the equivalent RRR). The exact time employed is not critical since the yttrium metal does not enter the niobium interior in any substantial amounts (see Table 2).

The purification process of this invention can be used in conjunction with other purification processes, for example decarburization, as a final process step to lower the final oxygen content.

After completion of the purification process of the invention the surface yttrium metal layer and yttrium oxide layer is removed for example by the use of an appropriate acid such as nitric acid. The niobium surface if desired, can be further pickled or otherwise treated to remove a few micrometers or more of niobium for added surface cleanliness for surface sensitive applications.

EXAMPLES

FIG. 1 shows results of several applications of a procedure which comprised loosely wrapping the niobium being purified in a yttrium foil and heating the composite in a furnace at $10^{-4}$ torr. The parameters varied are:

processing temperature, processing time, thickness of material and purity of starting Nb. For example the RRR of typical commercial sheet of ⅛" thickness is improved from 25 to 100 in 2 hours at 1250° C. This increase is tantamount to O removal of approximately 150 ppm. The best variety of commercial material obtained in one rare batch of 1/16" sheet improved its RRR value from 75 to 180 in 1 hour at 1250° C. This is tantamount to O removal of 39 ppm. 0.020" thick material prepared under carefully controlled laboratory type conditions of vacuum during melt and anneal stages increased its RRR value from 150 to 350 in 1 hour at 1150° C.

Table 2 presents chemical analysis and RRR results for two samples from a ⅛" sheet of typical commercial Nb. The processing was done for 1 hour at 1250° C. and resulted in an increase of RRR from 27 to 62.

TABLE 2

Chemical analysis and RRR measurements for treated (A) and untreated (B) typical commercial Nb, thickness ⅛".

| Sample | C | O (ppm wt) | N | Y | RRR calculated | RRR measured |
|---|---|---|---|---|---|---|
| A | 4 | 50 | 50 | — | 43 | 62 |
| B | 3 | 107 | 54 | <0.5 | 28 | 27 |

Table 3 presents chemical analysis, and RRR for two samples from a 1/16" thick sheet of commercial material with unusually higher purity. Sample A has been processed with Y and sample B has not. The processing was done for 50 minutes between 1000° C. and 1250° C.

TABLE 3

| Sample | C | O (ppm wt) | N | RRR calculated | RRR measured |
|---|---|---|---|---|---|
| A | 2 | 18 | 12 | 104 | 175 |
| B | <1 | 45 | 18 | 74 | 68 |

Both Table 2 and Table 3 show that the treatment has reduced the O content by a factor of 2 and has in addition removed a small quantity of N. Table 2 further shows that the amount of Y entering the Nb is less than 0.5 ppm.

Table 4 presents chemical analysis and RRR measurements on 2 samples from 1/16" thick sheet of commercial material with unusually higher purity. Sample A was annealed at 1150° C. for 1 hour in the same furnace in which the yttrium treatment has been carried out, but without any Y wrapping. Sample B is untreated. The comparison shows that without the Y wrapping, the Nb gets contaminated with O, N and C.

TABLE 4

Chemical Analysis and RRR measurements for an (A) annealed and (B) unannealed sample. Annealing was performed without Y foil in a diffusion pumped furnace at 1150° C. for one hour.

| Sample | C | O | N | RRR calculated | RRR measured |
|---|---|---|---|---|---|
| A | 20 | 70 | 34 | 36 | 49 |
| B | <10 | 48 | 17 | 72+ | 75 |

C = O assumed

It has been previously reported that heat treatment near 2000° C. in the KFK or BNL furnaces lowers the carbon and N content but increases the O content. When Y treatment is applied after such a firing, greater overall improvement is obtained. For example, Table 5 shows the effect of applying the Y treatment to 2 samples (C+D) from the same batch of 1/16" Nb, one prefired and the other not. Sample A has not undergone any type of treatment, Sample B has been fired only, Sample C has been yttrified (subjected to the process of the invention) without firing, and Sample D has been fired and then yttrified. Similarly an ⅛" commercial grade sample improved its RRR from 26 to 193 with yttrification plus firing whereas a comparison sample from the same batch improved to only 99 with yttrification only.

TABLE 5

Chemical analysis and RRR measurements for 1/16" Nb sample (A) untreated (B) fired at BNL (C) yttrified (D) fired at BNL plus yttrified.

| Sample | C | O | N | RRR calculated | RRR measured | Treatment |
|---|---|---|---|---|---|---|
| A | <10 | 48 | 17 | 72 | 75 | as is |
| B | <10 | 114 | 10 | 39 | 36 | fired |
| C | 2 | 18 | 12 | 141 | 175 | yttrified |
| D | — | — | — | — | 250 | fired and yttrified |

Figure 2:
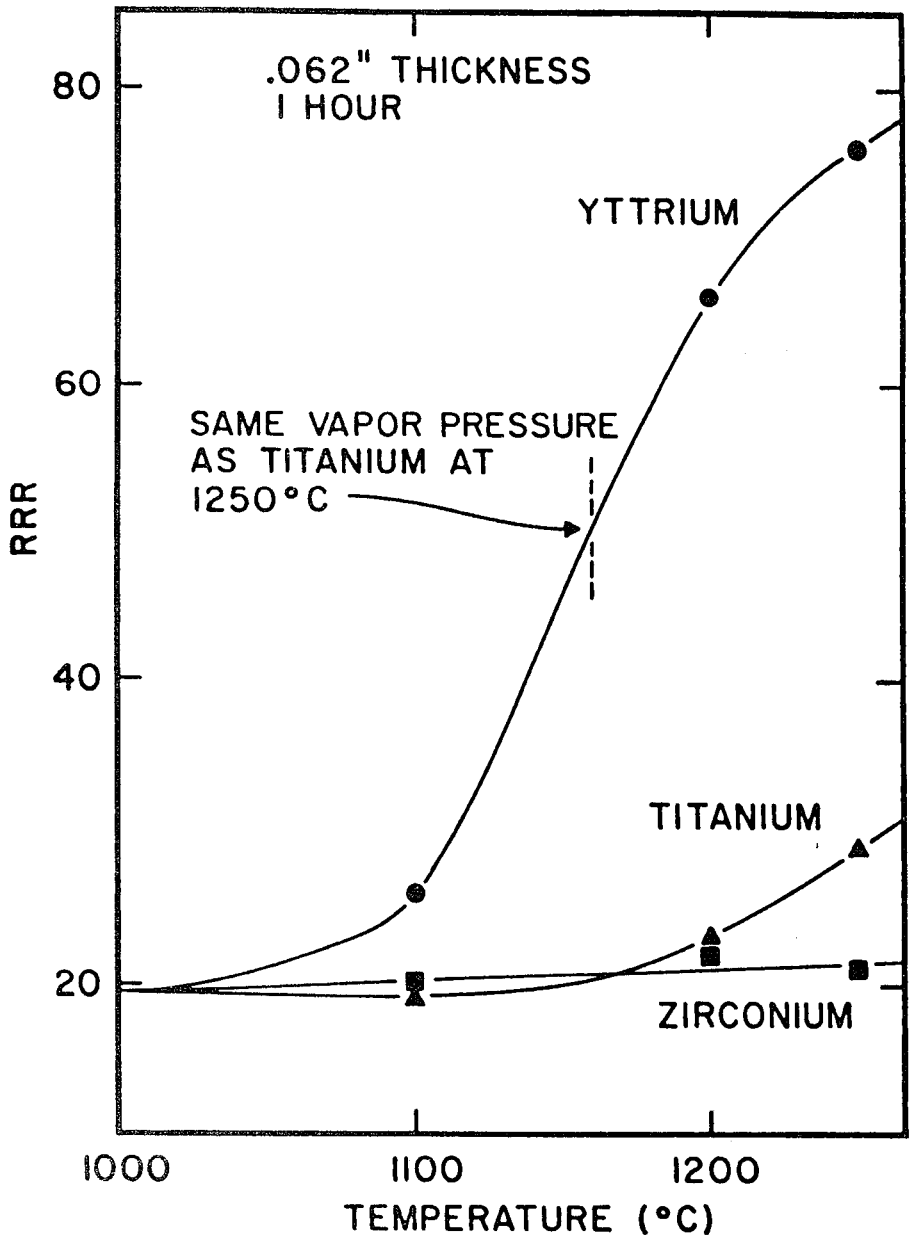

FIG. 2 shows that the effectiveness of yttrium is far greater than that of zirconium and titanium as purifier metals. Commercial grade niobium of RRR 20 is improved to 29 in 1 hour at 1250° C. using titanium, and to 76 in the same time, at the same temperature using yttrium. These improvements are tantamount to removal of 78 ppm and 184 ppm of oxygen for titanium and yttrium respectively. When comparisons between yttrium and titanium are made at the same vapor pressure yttrium is still more effective. For example at 1160° C., the vapor pressure of Y is the same as that of Ti at 1250° C. However, the RRR obtained with Y is 50 as compared to 29 with Ti.

If Zr and Ti are used for greater lengths of time or on thinner material, eventually comparable values of RRR as with Y can be achieved as shown in Table 6 and Table 7.

TABLE 6

Comparison between a long (4 hours) Ti treatment and a shorter (2 hour) Y treatment.

| Purifier | Thickness of Nb (inches) | Time (hours) | Temp. (°C.) | RRR Starting | RRR Final |
|---|---|---|---|---|---|
| Ti | .062 | 4 | 1250 | ~75 | 220 |
| Y | .062 | 2 | 1250 | ~75 | 211 |

TABLE 7

Comparison between Zr and Y for very thin Nb.

| Purifier | Thickness of Nb (inches) | Time (hours) | Temp. C | RRR Starting | RRR Final |
|---|---|---|---|---|---|
| Zr | .020 | 1 | 1250 | 201 | 323 |
| Y | .020 | 1 | 1150 | 150 | 350 |

In experiments with zirconium foil in place of yttrium foil it was found that one hour at 1150° C. improved the RRR of 0.062 thick material from 75 to 99 whereas a comparable treatment with Y on the same batch of material improved the RRR from 70 to 156.

It should be understood that the invention as described herein can be utilized within the scope of the disclosure in a manner other than specifically exemplified.

I claim:

1. A method of purifying solid niobium containing an impurity having a significant diffusion rate above about 1000° C., which comprises vapor depositing yttrium metal at a temperature above about 1000° C. in a vacuum of at least about $10^{-4}$ torr and for a time sufficient to cause migration of said impurity from the niobium into said vapor deposited layer.

2. The method of claim 1 where the impurity is oxygen.

3. The method of claim 1 where the temperature is between about 1200° C. to about 1400° C.

4. The method of claim 1, where the niobium is in the form of a shaped article and the yttrium metal is placed in close proximity to the surface of the niobium.

5. The method of claim 2 where the niobium is in the form of a shaped article and the yttrium metal is placed in close proximity to the surface of the niobium.

6. The method of claim 3 where the niobium is in the form of a shaped article and the yttrium metal is placed in close proximity to the surface of the niobium.

* * * * *